US006469724B1

(12) United States Patent
Hayashi et al.

(10) Patent No.: US 6,469,724 B1
(45) Date of Patent: Oct. 22, 2002

(54) THICK-FILM THERMAL PRINT HEAD AND ITS MANUFACTURING METHOD

(75) Inventors: Hiroaki Hayashi; Eiji Yokoyama; Takumi Yamade, all of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/807,817

(22) PCT Filed: Oct. 15, 1999

(86) PCT No.: PCT/JP99/05724

§ 371 (c)(1),
(2), (4) Date: Apr. 19, 2001

(87) PCT Pub. No.: WO00/23282

PCT Pub. Date: Apr. 27, 2000

(30) Foreign Application Priority Data

Oct. 22, 1998 (JP) ..... 10/300776

(51) Int. Cl.[7] ..... B41J 2/335
(52) U.S. Cl. ..... 347/204; 347/203
(58) Field of Search ..... 347/200, 203, 347/204, 206

(56) References Cited

U.S. PATENT DOCUMENTS 5,072,236 A * 12/1991 Tatsumi et al. ..... 347/203
5,387,559 A * 2/1995 Nagata et al. ..... 501/20

FOREIGN PATENT DOCUMENTS

| | | | | |
|---|---|---|---|---|
| EP | 0 395 978 A | | 11/1990 | ..... H01L/49/02 |
| EP | 0 782 152 A | | 7/1997 | ..... H01C/7/00 |
| JP | 54-44798 | * | 4/1979 | |
| JP | 54-85394 | * | 7/1979 | |
| JP | 02-63845 | | 3/1990 | ..... B41J/2/335 |

* cited by examiner

*Primary Examiner*—Huan Tran
(74) *Attorney, Agent, or Firm*—Michael D. Bednarek; Shaw Pittman LLP

(57) ABSTRACT

The thermal printhead (1) includes an insulating substrate (2), a heating resister (5) formed on the substrate (2), a first glass coat layer (7) formed on the substrate (2) for covering the heating resister (5), and a second glass coat layer (8) formed on the first glass coat layer (7). The heating resister (5) has a centerline average roughness not greater than 0.3 $\mu$m. The first glass coat layer (7) has a centerline average roughness not greater than 0.1 $\mu$m.

7 Claims, 2 Drawing Sheets

THICK-FILM THERMAL PRINT HEAD AND ITS MANUFACTURING METHOD

TECHNICAL FIELD

The present invention relates to a thick-film thermal printhead. Specifically, the present invention relates to a thick-film thermal printhead including a very hard glass layer for protection of the heating resister. Further, the present invention also relates to a method for manufacturing such a thick-film thermal printhead as the above.

BACKGROUND ART

An example of a prior art thick-film thermal printhead is shown in FIG. 5. The illustrated thermal printhead includes an insulating substrate 51, a glaze layer 52 formed on the substrate 51 for heat reservation, and a conductor pattern 53 formed on the glaze layer 52. The Conductor pattern 53 includes a common electrode, individual electrodes and so on. The thermal printhead further includes a heating resister 54 electrically connected with the conductor pattern 53, and a first glass coat layer 55 for protection of the heating resister 54, the conductor pattern 53 and the glaze layer.

In addition to these constituent elements described above, the above prior art thermal printhead further includes a second glass coat layer 56 formed on the first glass coat layer 55.

The second glass coat layer 56 is made of a highly strong glass material. Such an arrangement as described above is adopted in order to provide reliable protection to the heating resister 54 and others.

According to the prior art thermal printhead, the heating resister 54 is formed by first printing and then baking a predetermined resister paste on the glaze layer 52. Specifically, the paste material is a mixture of ruthenium oxide, a glass frit and a solvent. The glass frit has an average grain size of about 5 $\mu$m.

The first glass coat layer 55 is formed for example of an amorphous lead glass containing about 26.5% resin material and about 73.5% glass material. A glass paste for forming the glass layer 55 is a mixture of a glass frit and a solvent. The glass frit has a maximum grain size of about 10 $\mu$m.

The prior art thermal printhead is known to have a problem in the following point. Specifically, as described as above, the average grain size of the glass frit contained in the resister paste is about 5 $\mu$m. The heating resister 54 made from such a resister paste has a surface roughness expressed as centerline average roughness Ra of about 0.6 $\mu$m, which is a relatively large value. Next, the maximum grain size of the glass frit contained in the glass paste is about 10 $\mu$m as has been described.

The glass coat layer 55 made from such a glass paste has a surface roughness expressed as the centerline average roughness Ra of about 0.2 $\mu$m, which is a relatively large value.

As will be understood easily, if the centerline average roughness Ra on the surface of the heating resister 54 has a large value, the centerline average roughness Ra on the surface of the first glass layer 55 also has a large value (i.e. the first glass coat layer 55 has a poor state of surface). Under such a circumstance, if the second glass coat layer 56 is subjected to an impact force and so on, there is a possibility that stress concentration occurs in a specific location of the second glass coat layer 56. As a result, the second glass coat layer 56 may develop a crack for example, or the second glass coat layer 56 may flake off the first glass coat layer 55.

DISCLOSURE OF THE INVENTION

An object of the present invention is to provide a thick-film thermal printhead capable of eliminating or reducing the problem described above. In order to achieve the object, the present invention makes use of the following technical means.

A thermal printhead provided by a first aspect of the present invention comprises an insulating substrate, a heating resister formed on the substrate, a first glass coat layer covering the heating resister and formed on the substrate; and a second glass coat layer formed on the first glass coat layer, wherein the heating resister has a centerline average roughness not greater than 0.3 $\mu$m.

According to a preferred embodiment of the present invention, the first glass coat layer has the centerline average roughness not greater than 0.1 $\mu$m.

Preferably, the heating resister is formed from a paste material containing a glass frit having an average grain size not greater than 2 $\mu$m.

Further, the first glass coat layer may be formed from a paste material containing a glass frit having an average grain size not greater than 1.5 $\mu$m.

Preferably, the glass frit has a maximum grain size not greater than 6 $\mu$m.

According to a second aspect of the present invention, there is provided a method for making a thermal printhead including an insulating substrate, a heating resister formed on the substrate, a first glass coat layer covering the heating resister and formed on the substrate, and a second glass coat layer formed on the first glass coat layer. The method comprises the steps of forming the heating resister on the substrate, forming the first glass coat layer, covering the heating resister, and on the substrate, and forming the second glass coat layer on the first glass coat layer, wherein the heating resister is formed from a paste material containing a glass frit having an average grain size not greater than 2 $\mu$m.

According to a preferred embodiment of the present invention, the above method further includes a step of printing and baking the paste material.

Preferably, the first glass coat layer is formed from a paste material including a glass frit having an average size not greater than 1.5 $\mu$m. Preferably, the glass frit has a maximum grain size not greater than 6 $\mu$m.

The second glass coat layer can be formed by spattering.

Other features and advantages of the present invention will become clearer from an embodiment to be described with reference to the attached drawings.

BRIEF DESCRIPTION OF THE ATTACHED DRAWINGS

BEST MODE FOR CARRYING OUT THE INVENTION

Hereinafter, a preferred embodiment of the present invention will be described with reference to FIG. 1 - FIG. 4.

Figure 1:
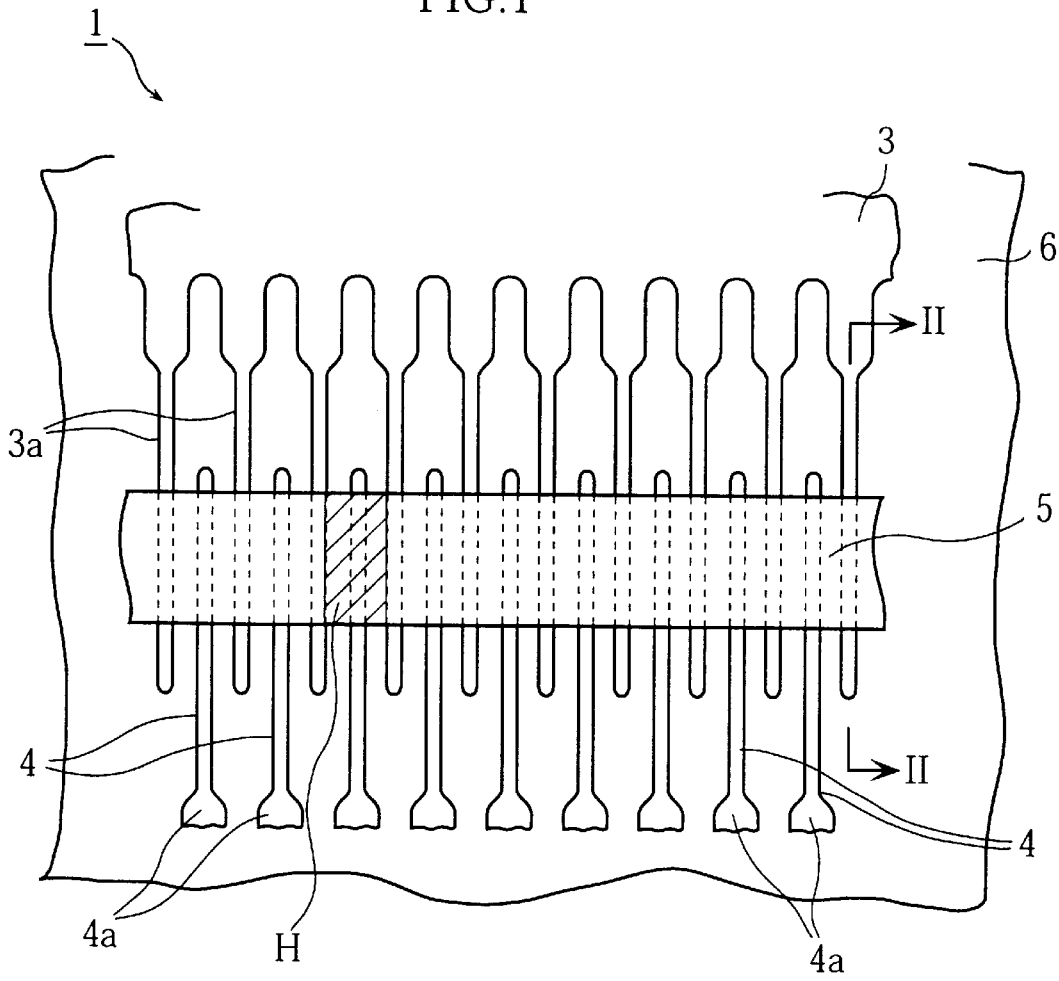
FIG. 1 is a plan view showing a principal portion of a thick-film thermal printhead according to the present invention.
Figure 2:
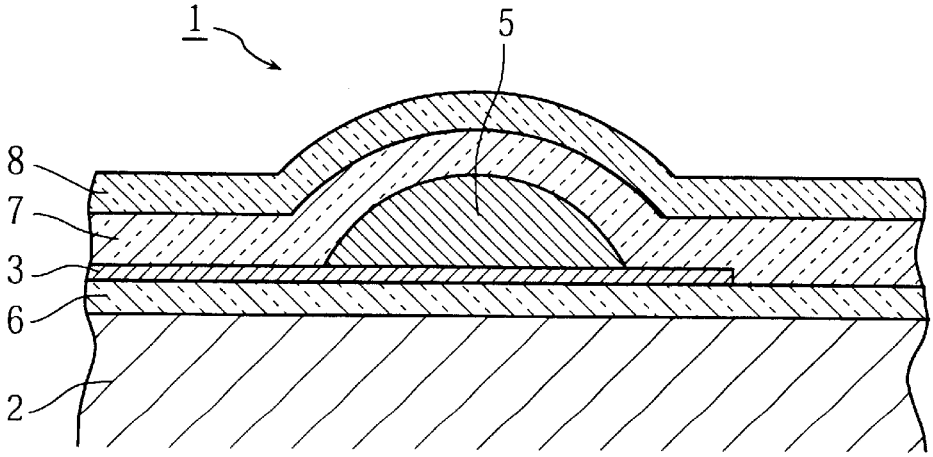
FIG. 2 is a sectional view taken in lines II—II in FIG. 1.

FIG. 1 and FIG. 2 show a principal portion of a thick-film thermal printhead (indicated wholly by numeral code 1) according to a preferred embodiment of the present invention. The thick-film thermal printhead 1 includes an insulating substrate 2 (FIG. 2) made of a ceramic. The substrate 2 has an upper surface formed with a glaze layer 6 for heat reservation. The glaze layer has an upper surface formed with a wiring pattern including a common electrode 3 and a plurality of individual electrodes 4.

As shown in FIG. 1, the common electrode 3 has a plurality of teeth-like electrode portion 3*a* (hereinafter simply called the "teeth"). These teeth 3*a* are disposed alternately with the individual electrodes 4, with each of the individual electrodes 4 partially sandwiched between a pair of mutually adjacent teeth 3*a*. Each of the individual electrodes 4 has an end portion formed with a bonding pad 4*a*. These bonding pads 4*a* are electrically connected with a drive IC (not illustrated).

As shown in FIG. 1, the upper surface of the glaze layer 6 is formed with a straight-line heating resister 5 electrically connecting the teeth and the individual electrodes 4. The heating resister 5 includes a plurality of regions H (only one is shown in FIG. 1) each defined by a pair of mutually adjacent teeth 3*a*. Each of the regions H serves as a heating dot.

As shown in FIG. 2, the upper surface of the glaze layer 6 is formed with a first glass coat layer 7, covering the common electrode 3, individual electrodes 4 and the heating resister 5. The first glass coat layer 7 has an upper surface formed with a second glass coat layer 8 having a high hardness and covering the first glass coating layer 7.

Next, the description will cover a method for making a thick-film thermal printhead 1 having the constitution as described above.

First, a glaze layer 6 is formed by applying and baking a glass material on an upper surface of a substrate 2. Then, a common electrode 3 and individual electrodes 4 are formed on the glaze layer 6. The formation of these electrodes are made by first printing a predetermined pattern of resinated gold on the glaze layer 6, then baking the printed pattern, and then etching unnecessary portions off the baked pattern.

Thereafter, as shown in FIG. 1, a heating resister 5 is formed across the common electrode 3 and the individual electrodes 4. The formation of the heating resister is made by printing and baking a pattern of resister paste on the glaze layer 6.

The resister paste for the formation of the heating resister 5 is a mixture of ruthenium oxide, a glass frit and a solvent. The glass frit has an average grain size not greater than 2 $\mu$m. By using a glass frit having such a small average grain size as the above, a remarkably smooth surface can be achieved in a finished heating resister 5. Specifically, the heating resister 5 has a surface centerline average roughness Ra not greater than 0.3 $\mu$m. The heating resister 5 has a maximum thickness of about 9 $\mu$m.

After the formation of the heating resister 5, a first glass coat layer 7 is formed, covering the common electrode 3, the individual electrodes 4 and the heating resister 5. The formation of the first glass coat layer is made by printing and baking a pattern of glass paste. The glass paste is a mixture of a glass frit and a solvent. The glass frit has an average grain size not greater than 1.5 $\mu$m or has a maximum grain size not greater than 6 $\mu$m. Therefore, the finished glass coat layer 7 has a remarkably smooth surface. Specifically, the glass coat layer 7 has a surface roughness as expressed in the centerline average roughness Ra not greater than 0.1 $\mu$m. The glass coat layer 7 has a thickness of about 6 $\mu$m.

After the formation of the first glass coat layer 7, a second glass coat layer 8 having a high hardness and covering an upper surface of the glass coat layer 7 is formed by spattering. The second glass coat layer 8 has a thickness of about 4 $\mu$m.

Figure 5:
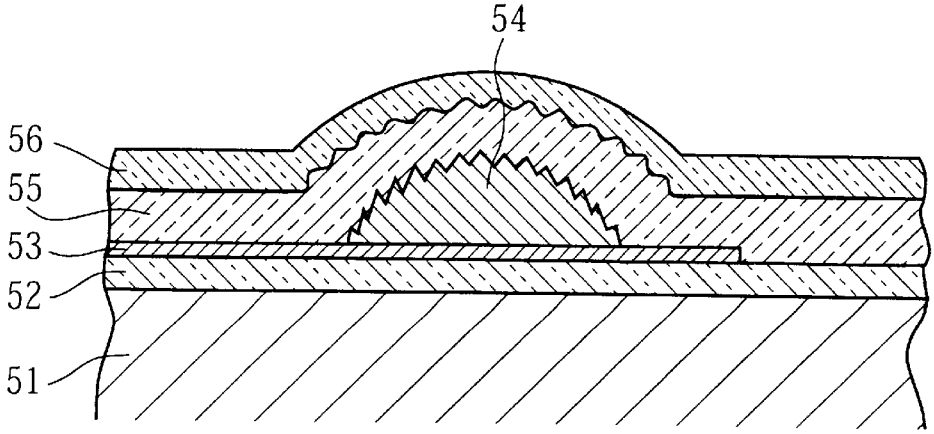
FIG.5 PRIOR ART
FIG. 5 is a sectional view showing a principal portion of a prior art thick-film thermal printhead.

Generally, the second glass coat layer 8 obtained by spattering has residual stress. Under such a circumstance as this, if the surface of the first glass coat layer 7 is not sufficiently smooth (See FIG. 5), when the second glass coat layer 8 is subjected to an impact and so on, there is a possibility that stress concentration occurs in a specific location of the second glass coat layer 8. As a result, the second glass coat layer 8 may develop a crack for example, or the second glass coat layer 8 may flake off the first glass coat layer 7, resulting in a failure.

According to the thermal printhead 1 provided by the present invention, the surface of the first glass coat layer 7 is remarkably smooth. Thus, such problems as described above can be effectively prevented.

Figure 3:
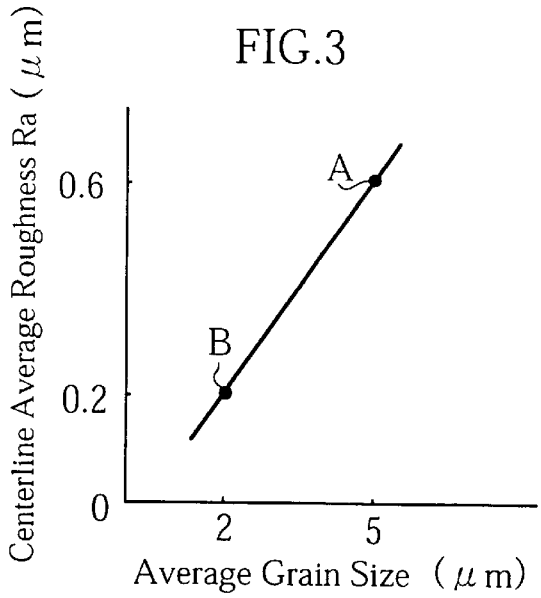
FIG. 3 is a graph showing a relationship between an average grain size of a glass frit contained in a resister paste and a centerline average roughness Ra on a surface of a heating resister.

The inventors of the present invention conducted an experiment in order to clarify relationship between an average grain size of the glass frit in the resister paste and the centerline average roughness Ra on a surface of the heating resister 5 formed from the resister paste. FIG. 3 is a graph showing a result of the experiment. The graph shows that the centerline average roughness Ra increases with increase in the average grain size of the glass frit.

According to the prior art thermal printhead, when the average grain size of the glass frit is about 5 $\mu$m, the centerline average roughness Ra on the surface of the heating resister is about 0.6 $\mu$m. This state corresponds to Point A in the graph. On the other hand, according to the preferred embodiment of the present invention, the average grain size of the glass frit is not greater than 2 $\mu$m. As understood from the graph in FIG. 3, when the average grain size is 2 $\mu$m, the centerline average roughness Ra is 0.2 $\mu$m (See Point B). Therefore, if the average grain size is not greater than 2 $\mu$m, the centerline average roughness Ra can be not greater than 0.2 $\mu$m.

Figure 4:
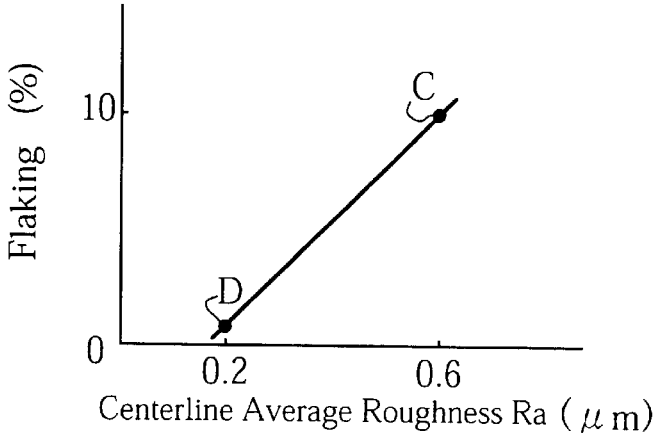
FIG. 4 is a graph showing a relationship between the centerline average roughness Ra and a rate of flaking off failure occurred on a second glass coat layer.

Next, reference will be made to FIG. 4. A graph in FIG. 4 shows a relationship between the centerline average roughness Ra on the surface of the heating resister and the rate of flaking failure found in the second glass coat layer. (This graph is also based on the experiment conducted by the inventors.) As understood from the graph, the flaking rate increases when the centerline average roughness Ra increases. In the prior art, the centerline average roughness Ra is about 0.6 $\mu$m, resulting in about 10% flaking failure rate (See Point C). On the contrary, when the centerline average roughness Ra is 0.2 $\mu$m, the flaking failure rate decreases to about 1% (See Point D). According to the preferred embodiment of the present invention, since the centerline average roughness Ra is 0.2 $\mu$m, the flaking failure rate can be decreased to not greater than about 1%.

Thus far, a thick-film thermal printhead according to the preferred embodiment of the present invention and a method for making the same have been described. The present invention however, is not limited by the embodiments. For example, in the preferred embodiment, a glass frit having a small average grain size is used in both of the resister paste for forming the heating resister and the glass paste for forming the first glass coat layer. Alternatively, it is also possible to use the glass frit of a small average grain size only in one of the resister paste and the glass paste.

What is claimed is:

1. A thermal printhead comprising:

an insulating substrate;

a heating resister formed on the substrate;

a first glass coat layer formed on the substrate by printing and baking a glass paste for covering the heating resister, the first glass coat layer being formed from a paste material containing a glass frit having an average grain size not greater than 1.5 μm; and a second glass coat layer formed on the first glass coat layer by spattering; wherein the heating resister has a centerline average roughness not greater than 0.3 μm.

2. The thermal printhead according to claim 1, wherein the first glass coat layer has the centerline average roughness not greater than 0.1 μm.

3. The thermal printhead according to claim 1, wherein the heating resister is formed from a paste material containing a glass frit having an average grain size not greater than 2 μm.

4. The thermal printhead according to claim 1, wherein the glass frit contained in the paste material for the formation of the first glass coat layer has a maximum grain size not greater than 6 μm.

5. A method for making a thermal printhead which comprises an insulating substrate, a heating resister formed on the substrate, a first glass coat layer formed on the substrate for covering the heating resister, and a second glass coat layer formed on the first glass coat layer, the method comprising steps of:

forming the heating resister on the substrate;

forming the first glass coat layer on the substrate by printing and baking a glass paste for covering the heating resister, the glass paste including a glass frit having an average grain not greater than 1.5 μm; and forming the second glass coat layer on the first glass coat layer by spattering; wherein the heating resister is formed from a paste material containing a glass frit having an average grain size not greater than 2 μm.

6. The method according to claim 5, further comprising a step of printing and baking the paste material for the formation of the heating resister.

7. The method according to claim 5, wherein the glass frit contained in the glass paste for the formation of the first glass coat layer has a maximum grain size not greater than 6 μm.

* * * * *